US005470065A

United States Patent [19]

Hilchie

[11] Patent Number: 5,470,065

[45] Date of Patent: Nov. 28, 1995

[54] SLIDER PUZZLE

[76] Inventor: Robert Hilchie, 2-323A Avondale Ave., Ottawa, Ontario, K1Z 7G7, Canada

[21] Appl. No.: 293,686

[22] Filed: Aug. 19, 1994

Related U.S. Application Data

[63] Continuation of Ser. No. 88,921, Jul. 7, 1993, abandoned.

[51] Int. Cl.[6] ..... A63F 9/08

[52] U.S. Cl. ..... 273/155

[58] Field of Search ..... 273/155, 153 R, 273/156

[56] References Cited

U.S. PATENT DOCUMENTS

| | | | |
|---|---|---|---|
| 3,601,403 | 8/1971 | Weisbecker | 273/155 X |
| 4,524,971 | 6/1985 | Sasso . | |
| 4,811,948 | 3/1989 | Gutiérrez . | |

FOREIGN PATENT DOCUMENTS

| | | | |
|---|---|---|---|
| 2622465 | 5/1989 | France | 273/155 |
| 2186495 | 8/1987 | United Kingdom | 273/153 S |

OTHER PUBLICATIONS

Magnif Inc. (Mentor, Ohio), Brain™ Puzzler™ (Container box and writings thereon).

*Primary Examiner*—Raleigh W. Chiu
*Attorney, Agent, or Firm*—Robert M. Phipps

[57] ABSTRACT

A slider puzzle with an assembly of slide members is provided. Each slide member intersects with at least one other slide member at an intersection point and is moveable between two end stop positions or any number of positions in between. Each slide member is also provided with a gate selectively located at each intersection point in accordance with a pre-determined sequence or sequences of moves. The gate either allows or prohibits movement of an intersecting slide member relative to the gate between the two end positions in whole or fractional increments. The object of the slider puzzle is to move all slide members in order that the puzzle is in a solved configuration.

22 Claims, 4 Drawing Sheets

SLIDER PUZZLE

This is a continuation, of application Ser. No. 08/088, 921, filed Jul. 7, 1993 now abandoned.

FIELD OF THE INVENTION

The present invention relates to a slider puzzle with an assembly; of intersecting sliders. The puzzle may be moved from an initial to a solved configuration in accordance with a predetermined sequence or sequences of moves. Movements of individual sliders are enabled by the interaction of respective gate means on each slider.

BACKGROUND OF THE INVENTION

Puzzles that are solved through a sequence of non-obvious moves present an intellectual challenge to a user trying to determine the solution to the puzzle. Such puzzles may be of a two-dimensional or three-dimensional form and may involve movement of pieces to create external surfaces of a particular pattern or to key together a number of components in order to create a unified shape.

In the past, a slider puzzle with a series of intersecting sliders that enables the user to move the puzzle between an initial and solved configuration in accordance with a predetermined sequence or sequences of moves has not been provided where the ability for movement of a particular slider is determined by the relative position of an intersecting slider. Furthermore, a slider puzzle has not been provided that can be designed with either an arbitrary or patterned sequence of moves to the solved configuration.

PRIOR ART

U.S. Pat. No. 4,811,948 discloses a cube and pegs assembly puzzle that requires the user to plug a series of non-through holes recessed in a cube with a series of pegs. The holes on each face intersect with corresponding holes on the other faces. The pegs are provided with a series of specifically located notches which either allow another peg to be inserted in a corresponding hole or obstruct its passage. Pegs may have to be rotated to allow an intersecting peg to be inserted. The object of the puzzle is to determine which peg is to be inserted into which hole in the correct sequence. This puzzle does not enable the user to have an unobstructed view into the interior of the cube to consider the interaction of pegs at a particular intersection point. The solution of this puzzle is not through bi-directional movement of individual pegs within the holes.

U.S. Pat. No. 4,524,971 discloses a two dimensional puzzle with a plurality of interlocking moveable pieces on a planar board. The object of this puzzle is to move the pieces on the board in order to satisfy a predetermined indicia pattern. An individual piece may be moved through movement of a set of pieces. This puzzle does not disclose a plurality of slidable members intersecting with one another where the ability to move one member is determined by the relative position of an intersecting member.

Magnif Inc. (Mentor, Ohio) produces a product called the Brain™ puzzler™ which requires the puzzle solver to manipulate a series of pegs from an initial to a solved position according to a single sequence of moves. The puzzle is comprised of a series of pegs and disks which interact with one another to either allow or prevent movement of an individual peg. Individual pegs do not intersect with one another and this device does not permit manipulation of the disk components.

SUMMARY OF THE INVENTION

In accordance with the present invention a slider puzzle is provided comprising an assembly of slide members. Each slide member intersects with at least one other slide member at an intersection point and each slide member is moveable between two end stop positions or any number of positions in between. Each slide member is provided with gate means selectively located on each slide member at each intersection point in accordance with a predetermined sequence or sequences of moves. The gate means either allows or prohibits movement of an intersecting slide member relative to the gate means between the two end stop positions in whole or fractional increments. The object of the slider puzzle is to move all slide members in order that the puzzle is in a solved configuration. The pre-determined sequences of moves are series of whole or fractional movements of individual slide members between the end stop positions.

BRIEF DESCRIPTION OF THE DRAWINGS

The invention is illustrated by way of example in the accompanying drawings in which.

DETAILED DESCRIPTION OF THE INVENTION

Figure 1:
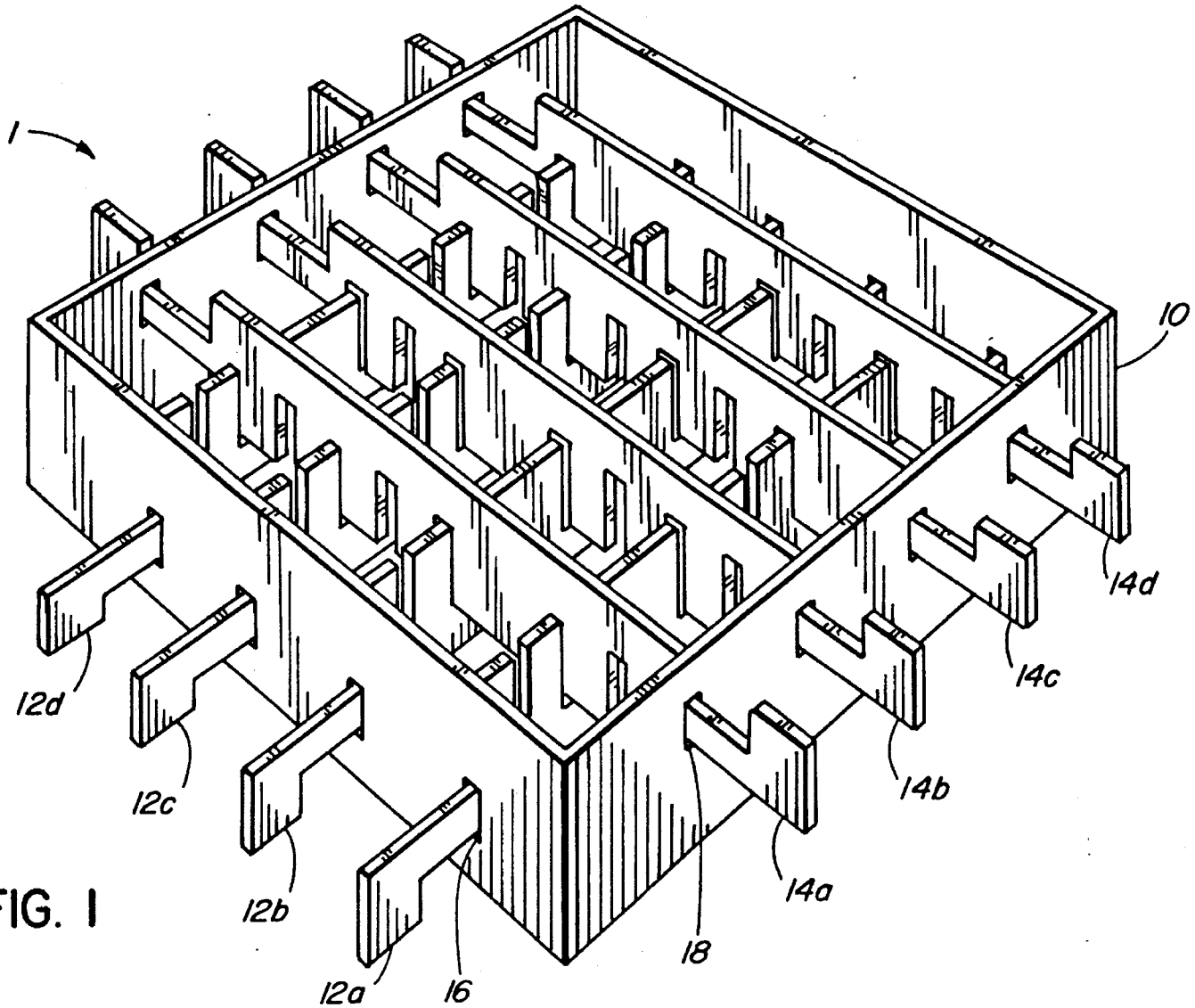
FIG. 1 is an isometric view of an embodiment of the invention with two axes of sliders.

A slider puzzle 1 in accordance with the invention is shown in FIG. 1 with a frame 10, four east-west sliders 12*a*, 12*b*, 12*c*, and 12*d*, and four north-south sliders 14*a*, 14*b*, 14*c*, and 14*d*. Sliders 12 and 14 are retained within frame 10 by slots 16 and 18 respectively. Reference is made herein to east, west, north and south for convenience in orientation of the parts.

It is preferable that the frame 10 is open to permit visibility to the individual intersection points of respective sliders.

Figure 2:
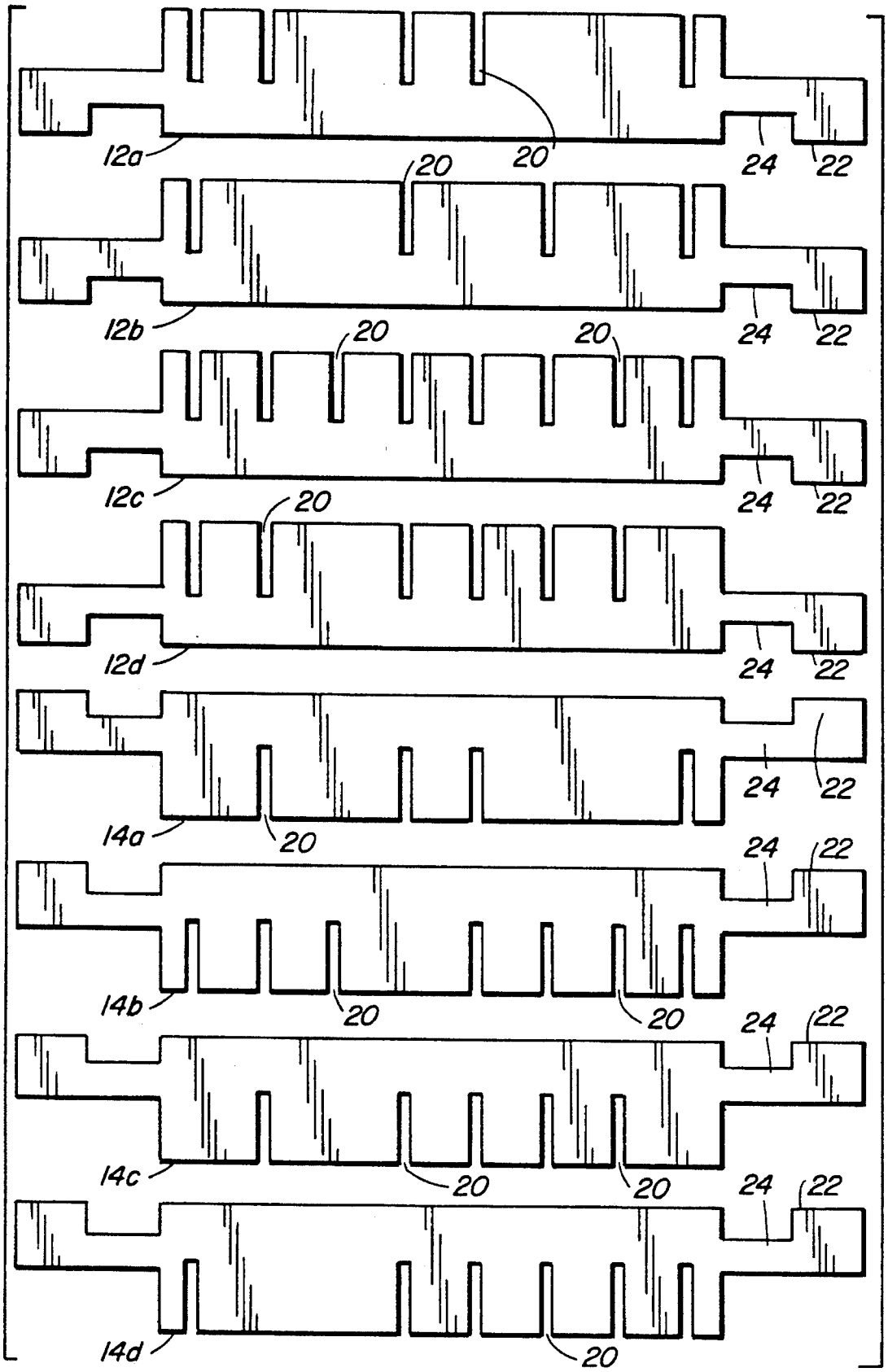
FIG. 2 is an elevation of individual sliders with kerfs of the embodiment shown in FIG. 1.

Each slider 12 and 14 is provided with a series of kerfs 20 as shown in FIG. 2 located along one side of the slider. The location of each kerf 20 is positioned according to the particular move sequences of the puzzle, as illustrated in example 1. The relative overlap between the east-west sliders 12 and north-south sliders 14 within frame 10 corresponds to the depth of each kerf 20. The purpose of the overlap is for sliders 12 and 14 and kerfs 20 to interfere with each other to either prohibit or allow movement. The sliders 12 and 14 may also be provided with stopping keys 22 at each end which limit the movement of a slider 12 or 14 through slot 16 or 18 and relative to frame 10. Sliders 12 and 14 are also provided with tabs 24, the length of which corresponds to at least the total displacement between the initial and solved positions for each slider.

Sliders 12 and 14 are positioned within the frame 10 in order that each east-west slider 12 intersects and overlaps with each north-south slider as permitted by the depth of the kerf 20.

A configuration of the slider puzzle 1 may be defined to be the positions of all the sliders at any stage of play. Typically, in the initial configuration, all the sliders extend from one side of frame 10, while-in the solved configuration, they extend from the opposite side of the frame 10.

Figure 3:
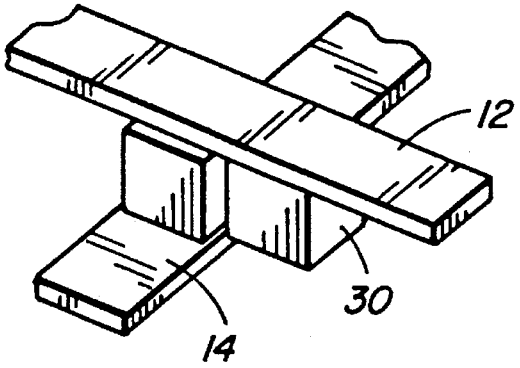
FIG. 3 is an isometric view of an individual intersection point where the sliders are provided with blocks.
Figure 4:
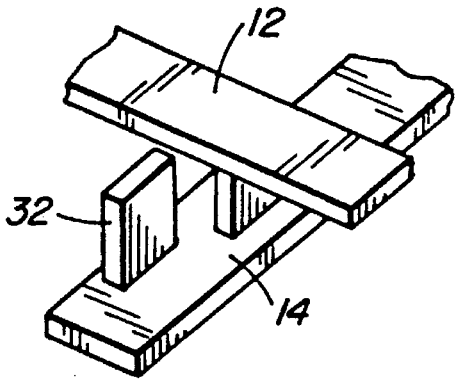
FIG. 4 is an isometric view of an individual intersection point where the sliders are provided with half-blocks.

In an alternative embodiment, the sliders may be provided with blocks 30 or half blocks 32 as shown in FIGS. 3 and 4 respectively instead of kerfs. A combination of blocks and half blocks may also be used to provide a degree of visual complexity to the slider puzzle 1.

Figure 5:
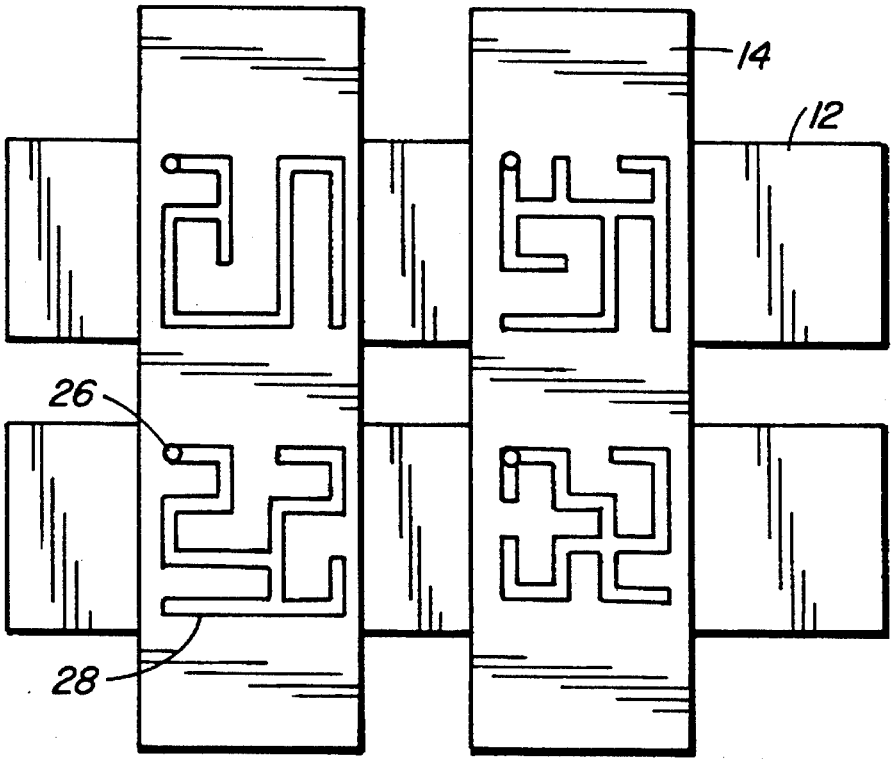
FIG. 5 is a plan view of an alternative embodiment of the invention with sliders provided with either a pin or slotted maze at each intersection point.
Figure 4A:
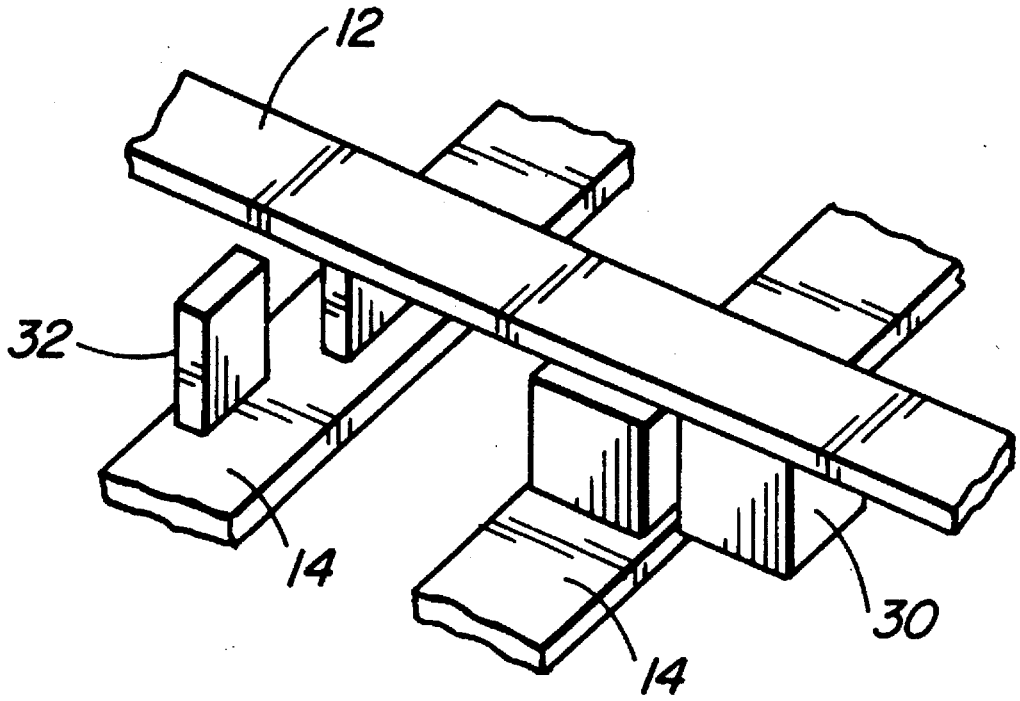
FIG. 4*a* is an isometric view of two intersections points where the sliders are provided with blocks or half-blocks.

In accordance with an alternative embodiment of the invention, FIG. 5 shows a slider puzzle with two east-west sliders 12 and two north-south sliders 14. In this embodiment, each of the sliders have four positions including the end positions. In this embodiment, the east-west sliders 12 are provided with pins 26 at each intersection point which protrude through a slotted maze 28 in the north-south slider 14. The puzzle is solved in the same manner as above between an initial and solved configuration by moving individual sliders. In this embodiment, the sliders are permitted to move only in incremental fractions of the total displacement between the end positions. This embodiment of the slider puzzle 1 is designed in the same manner as described below for kerfs 20 where instead of a kerf being provided at a specific position, a slot is provided that enables the movement of the individual slider.

Any fractional increment between the end positions may be utilized in the design of a particular puzzle. Increments, such as 1/1, 1/2, 1/3 or 1/4 produce a desirable level of complexity to the puzzle.

A slider puzzle 1 may be provided with an arbitrary or patterned sequence of moves at the discretion of the puzzle designer.

The slider puzzle may also be provided with a third set of sliders in a vertical arrangement.

EXAMPLE 1

Design of a Slider puzzle with 3 horizontal and 3 vertical sliders

The east-west sliders are labelled h1, h2, h3 and the north-south sliders labelled v1, v2 and v3. Kerfs may be located in 6 different positions, labelled as 1,2,3,4,5,6 for the horizontal sliders and a,b,c,d,e,f for the vertical sliders as shown;

```
h3  123456      h3  —f—f—f
     | | |           e e e
h2  123456      h2  —d—d—d
     | | |           c c c
h1  123456      h1  —b—b—b
     | | |           a a a
    v v v           v v v
    1 2 3           1 2 3
```

A. The designer will decide upon particular sequences of moves the puzzle will allow. In this example, the initial configuration is defined as the configuration where the horizontal sliders are in the west position and the vertical sliders are in the south position. The solved configuration is defined as the configuration where the horizontal sliders are in the east position and the vertical sliders are in the north position.

For a solution with 10 moves to solve the slider puzzle, the sequential moves may be decided to be:

1. v3 N
2. H1 E
3. V1 N
4. H2 E
5. V1 S
6. H1 W
7. V2 N
8. H1 E
9. V1 N
10. H3 E

B. Progress through individual moves to determine the position of the kerfs needed to allow that move to be made.

1. v3 N: At this stage, all east-west sliders are in the west position, so kerfs are provided in each east-west slider at position 6.

```
          |
h3  123456
     | | |
h2  123456
     | | |
h1  123456
     | |

    v v v
    1 2 3
```

2. h1 E: At this stage, v1 and v2 are in the south position, so kerfs are provided at position b. v3 is in the north position, so a kerf is provided at position a in v3.

```
        f
h3  -f-f-e
    e e d
h2  -d-d-c
    c c b
h1  b-b-a-
    a a

    v v v
    1 2 3
```

3. v1 north: At this stage, h1 is in the east position, so a kerf is provided at position 1 in h1. h2 and h3 are in the west position, so a kerf is provided in h2 and h3 at position 2.

```
     |   |
h3  123456
     | | |
h2  123456
     | | |
h1  123456'
       |
    v v v
    1 2 3
```

4. h2 east: At this stage, v1 and v3 are in the north position, so kerfs are provided in v1 and v3 at position c. v2 is in the south position, so a kerf is provided in v2 at position d.

```
     f   f
h3  -e-f-e
     d e d
h2  c-d-c-
     b c b
h1  a-b-a-
       a

     v v v
     1 2 3
```

5. v1 south: At this stage, h2 is in the east position, so a kerf is provided in h2 at position 1. Kerfs have already been provided in position 1 of h1 and position 2 of h3.

```
          |
h3  123456
     | | |
h2  123456
     | | |
h1  123456
     | |

     v v v
     1 2 3
```

6. h1 west: Kerfs have already been provided in position b of v1 and v2 and position a of v3.

```
          f
h3  -f-f-e
     e e d
h2  d-d-c-
     c c b
h1  -b-b-a
     a a

     v v v
     1 2 3
```

7. v2 north: At this stage, h1 and h3 are in the west position, so kerfs are provided in h1 and h3 at position 4. h2 is in the east position, so a kerf is provided at position 3.

```
        | |
h3  123456
     | | |
h2  123456
     | | |
h1  123456
       |

     v v v
     1 2 3
```

8. h1 east: At this stage, v2 is in the north position, so a kerf is provided at position a. Kerfs have already been provided at position b in v1 and position a in v3.

```
       f f
h3  -f-e-e
     e d d
h2  d-c-c-
     c b b
h1  b-a-a-
     a

     v v v
     1 2 3
```

9. v1 north: Kerfs have already been provided at position 1 in h1 and h2 and at position 2 in h3.

```
     | | |
h3  123456
     | | |
h2  123456
     | | |
h1  123456
     v v v
     1 2 3
```

10. h3 east: At this stage, v1, v2 and v3 are in the north position, so a kerf is provided at position e in v1, v2 and v3. The puzzle is now in the solved configuration.

```
     f f f
h3  e-e-e-
     d d d
h2  c-c-c-
     b b b
h1  a-a-a-

     v v v
     1 2 3
```

This approach guarantees that the chosen sequence will be allowed by the slider puzzle, but may also allow additional, unintended sequences.

It should be noted that when deciding on sequences, careful re-use of subsequences in forward or reverse order can help lengthen the sequences while minimizing the number of kerfs to be cut and minimizing the number of unintended sequences arising.

EXAMPLE 2

Puzzle with 4 East-West Sliders and 4 North-South Sliders with Two Sequences of Moves The puzzle illustrated in FIGS. 1 and 2 was designed in accordance with following two sequences of moves, both of which start at the initial configuration. In the configuration illustrated in FIG. 1, sliders 12*b* and 14*b* may be starting moves.

| Moves | Description |
|---|---|
| | Sequence A (80 Moves = $3^4 - 1$) |
| 1 | 12b E |
| 2 | 14a N |
| 3 | 12a E |
| 4–5 | same as Moves 1 and 2 but in reverse order (ie 14a S, 12b W) |
| 6 | 14c N |
| 7–8 | same as 1 and 2 |
| 9 | 12 d E |
| 10–17 | same as 1–8 but reversed and in reverse order |
| 18 | 14d N |
| 19–26 | same as 1–8 |
| 27 | 12c E |
| 28–53 | same as 1–26 but reversed and in the reverse order |
| 54 | 14b N |
| 55–80 | same as 1–26 |
| | Sequence B (27 moves = $3^3$ moves) |
| 1 | 14b N |
| 2–27 | same as moves 1–26 of Sequence A |

It should be noted that Sequence B does not lead to the solved configuration but is rather a dead-end provided to confound the user. For this example, the shortest sequence which leads to the solved configuration is the 80 move Sequence A.

A puzzle having n horizontal sliders and n vertical sliders and two positions for each slider may be designed such that $3^n-1$ moves are required to solve it, and having a dead-end sequence of $3^{(n-1)}$ moves, as above where n=4.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the claims.

The embodiments of the invention in which an exclusive property or privilege is claimed are defined as follows:

1. A puzzle comprising:

a plurality of permanently intersecting puzzle members, each puzzle member confined for longitudinal movement between opposed end positions, each puzzle member having one or more possible longitudinal positions, each puzzle member having a plurality of gate means, the gate means defining permissable longitudinal movement of each associated intersecting puzzle member in each of the one or more possible longitudinal positions of said puzzle member, the gate means being arranged so as to require a predetermined sequence of movements of said puzzle members in order to position all of said puzzle members in a solved configuration; and, a housing for permanently interconnecting the puzzle members and to define the end stop positions, the housing also to confine each puzzle member to movement between the opposed end stop positions.

2. A puzzle as defined in claim 1 wherein each puzzle member is further provided with gripping means projecting through opposite sides of said housing to enable manipulation of said puzzle members from outside said housing.

3. A puzzle as defined in claim 2 wherein the gate means are kerfs recessed in an individual puzzle member which permits longitudinal movement therethrough of an associated intersecting puzzle member.

4. A puzzle as defined in claim 2 wherein the gate means comprise a block or half-block projecting from one puzzle member which cooperates with a corresponding block or half-block on the associated intersecting puzzle member.

5. A puzzle as defined in claim 2 wherein the puzzle members are elongated planar members for providing non-rotational stability to the puzzle members.

6. A puzzle as defined in claim 1 wherein the gate means are kerfs recessed in an individual puzzle member which permits longitudinal movement therethrough of an associated intersecting puzzle member.

7. A puzzle as defined in claim 1 wherein the gate means comprise a pin projecting from one puzzle member which cooperates with a slotted maze on the associated intersecting puzzle member, said slotted maze including a first plurality of longitudinal slots enabling longitudinal movement of said one puzzle member and a second plurality of transverse slots perpendicularly disposed to said first plurality of slots enabling longitudinal movement of said intersecting puzzle member.

8. A puzzle as defined in claim 1 wherein the gate means comprise a block or half-block projecting from one puzzle member which cooperates with a corresponding block or half-block on the associated intersecting puzzle member.

9. A puzzle as defined in claim 1 wherein the puzzle members are elongated planar members for providing non-rotational stability to the puzzle members.

10. A puzzle comprising:

a housing;

a first plurality of parallel puzzle members permanently confined for longitudinal forward and backward movement within said housing between opposed end stop positions;

a second plurality of parallel puzzle members intersecting with each puzzle member of said first plurality of puzzle members, said second plurality of puzzle members permanently confined for longitudinal forward and backward movement within said housing between opposed end stop positions;

each puzzle member having:

one or more possible longitudinal positions;

gripping means projecting through at least one side of said housing for manipulating said puzzle members from outside said housing;

gate means defining permissable longitudinal movement of each associated intersecting puzzle member in each of the one or more possible longitudinal positions of said puzzle member, the gate means being arranged so as to require a predetermined sequence of movements of said puzzle members in order to position all of said puzzle members in a solved configuration.

11. A puzzle as defined in claim 10 wherein the gate means are kerfs recessed in an individual puzzle member which permits longitudinal movement of an intersecting puzzle member.

12. A puzzle as defined in claim 11 wherein the first plurality of puzzle members are perpendicular with respect to the second plurality of puzzle members.

13. A puzzle as defined in claim 10 wherein the gate means are blocks or half-blocks or a combination of blocks and half-blocks which permit longitudinal movement of an intersecting puzzle member.

14. A puzzle comprising:

a housing;

a first plurality of parallel puzzle members permanently intersecting with a second plurality of parallel puzzle members, each puzzle member confined for longitudinal forward and backward movement within said housing between opposed end stop positions;

each puzzle member provided with gate means defining permissable longitudinal movement of each associated intersecting puzzle member in each of the one or more possible longitudinal positions of said intersecting puzzle member, the gate means being arranged so as to require a predetermined sequence of movements of said puzzle members in order to position all of said puzzle members in a solved configuration, each said gate means comprising a pin projecting from one puzzle member which cooperates with a slotted maze on the associated intersecting puzzle member, said slotted maze including a first plurality of longitudinal slots enabling longitudinal movement of said one puzzle member and a second plurality of transverse slots perpendicularly disposed and connected to said first plurality of slots enabling longitudinal movement of said intersecting puzzle member.

15. A puzzle comprising:

a housing having first and second pairs of opposed end walls forming an open box, each end wall having a plurality of slots, each slot aligned with a corresponding slot on the opposed end wall;

a first plurality of elongated and planar parallel puzzle members permanently confined for longitudinal forward and backward movement within the slots of said first end walls between opposed end stop positions;

a second plurality of elongated and planar parallel puzzle members perpendicularly intersecting with each puzzle member of said first plurality of puzzle members, said second plurality permanently confined for longitudinal forward and backward movement within the slots of said second end walls between opposed end stop positions;

each puzzle member having one or more possible longitudinal positions, each puzzle member further provided with gripping means projecting through opposite sides of said housing to enable movement of said puzzle members from outside said housing;

gate means on each puzzle member defining permissable longitudinal movement of each associated intersecting puzzle member in each of the one or more possible longitudinal positions of said puzzle member, the gate means being an open or closed kerf, the open kerfs being arranged so as to require a predetermined sequence of movements of said puzzle members in order to position all of said puzzle members in a solved configuration.

16. A puzzle comprising:

a plurality of permanently intersecting puzzle members, each puzzle member confined for longitudinal movement between opposed end positions and any number of intermediate positions, each puzzle member intersecting with at least one other puzzle member at an intersection point;

gate means selectively located on each puzzle member at each intersection point in accordance with a pre-determined sequence or sequences of moves in order to position all of said puzzle members in a solved configuration, the gate means allowing or prohibiting movement of an intersecting puzzle member relative to the gate means between the opposed end positions in whole or fractional increments; and, a housing for mounting the puzzle members.

17. The puzzle of claim 16 wherein the plurality of puzzle members are represented as two distinct groups, an east-west group with east-west puzzle members and a north-south with north-south puzzle members, where each east-west puzzle member intersects with each north-south puzzle member.

18. The puzzle of claim 17 wherein the gate means are kerfs recessed in the puzzle members.

19. The puzzle as claimed in claim 16 wherein the fractional increment of each puzzle member between the opposed end positions is 1/1, 1/2, 1/3 or 1/4.

20. The puzzle as claimed in claim 16 wherein the gate means is a pin on one puzzle member which cooperates with a slotted maze on the intersecting puzzle member.

21. The puzzle as claimed in claim 16 wherein the gate means are blocks or half-blocks or a combination of blocks and half-blocks.

22. A puzzle comprising:

a housing;

a plurality of at least 3 east-west puzzle members and at least 3 north-south puzzle members, each east-west puzzle member permanently intersecting with each north-south puzzle members at an intersection point, each puzzle member confined for longitudinal movement within said housing between opposed end positions and any number of intermediate positions;

gate means selectively located on each puzzle member at each intersection point in accordance with a pre-determined sequence or sequences of moves in order to position all of said puzzle members in a solved configuration, the gate means allowing or prohibiting movement of an intersecting puzzle member relative to the gate means between the opposed end positions in whole or fractional increments.

* * * * *